United States Patent [19]

Kotyk

[11] 4,249,868

[45] Feb. 10, 1981

[54] PUMP FOR HIGH VISCOSITY LUBRICANTS WITH IMPROVED PRIMING FEATURE

[75] Inventor: Jeffery M. Kotyk, St. Louis, Mo.

[73] Assignee: McNeil Corporation, Akron, Ohio

[21] Appl. No.: 9,541

[22] Filed: Feb. 5, 1979

[51] Int. Cl.[3] ..... F04B 7/04; F04B 21/04

[52] U.S. Cl. ..... 417/511; 417/457; 417/495

[58] Field of Search ..... 417/511, 469, 514, 55 L, 417/550, 554, 457, 495

[56] References Cited

U.S. PATENT DOCUMENTS

| | | | |
|---|---|---|---|
| 1,970,591 | 8/1934 | Barks | 184/7 |
| 2,057,874 | 10/1936 | Barks et al. | 222/47.5 |
| 2,253,926 | 8/1941 | Anderson et al. | 417/511 |
| 2,261,469 | 11/1941 | Hanfer | 417/554 |
| 2,409,962 | 10/1946 | Shearman | 417/460 |
| 2,464,030 | 3/1949 | Engstrom | 417/511 |

FOREIGN PATENT DOCUMENTS

| | | | |
|---|---|---|---|
| 2332250 | 3/1975 | Fed. Rep. of Germany | 417/457 |

*Primary Examiner*—William L. Freeh

*Attorney, Agent, or Firm*—Senniger, Powers, Leavitt and Roedel

[57] ABSTRACT

A pump for pumping high viscosity lubricants such as wheel bearing grease comprising a pump tube adapted to be disposed within a container of the lubricant, a piston rod and piston movable within the tube, an outlet at the upper end of the tube, an inlet at the lower end, a check valve in the piston and a valve at the inlet. Upon the piston downstroke, the inlet is closed by the valve and lubricant is transferred through the check valve in the piston from below to above the piston. Upon the piston upstroke, lubricant above the piston is forced out the outlet and lubricant is drawn into the tube below the piston through the then open inlet. The inlet valve is constructed so that it cooperates with the piston to develop a vacuum at the inlet before the inlet is opened. Upon opening the inlet, there is then a sudden exposure of the lubricant surrounding the inlet to the vacuum which draws even high viscosity lubricant into the tube to prime it. Reliable pump priming is thus achieved.

15 Claims, 7 Drawing Figures

PUMP FOR HIGH VISCOSITY LUBRICANTS WITH IMPROVED PRIMING FEATURE

BACKGROUND OF THE INVENTION

This invention relates to pumps, and more particularly, to a piston-type pump for pumping material such as a lubricant, and especially for pumping a relatively high viscosity lubricant such as wheel bearing grease.

This invention involves an improvement in pumps of the type such as shown for example in U.S. Pat. Nos. 1,970,591 and 2,057,874, generally comprising a pump tube, having an inlet at one end (its lower end), an outlet at its upper end, a valved piston slidable in the tube, and a valve for the inlet, the latter valve opening on an upstroke of the piston for priming of the pump tube and closing on a downstroke of the piston for forcing material from below the piston through the piston (the valve in the piston opening for this purpose) to the tube above the piston. Pumps of this type, and such as shown in said patents, have generally been satisfactory for pumping materials (e.g., lubricants), but may present the problem when used for pumping lubricants or other materials of high viscosity such as wheel bearing grease, of losing prime due to the difficulty attendant upon flow of the high viscosity material through the inlet into the tube. In pumps of this type, the vacuum developed at the inlet during the piston upstroke to draw lubricant into the tube develops gradually and may not be wholly effective to overcome the resistance to flow of high viscosity lubricant into the pump tube below the piston, thereby causing priming problems.

SUMMARY OF THE INVENTION

Among the several objects of this invention may be noted the provision of an improved pump of the class described adapted for pumping high viscosity lubricant (e.g., wheel bearing grease) without loss of prime.

Briefly, the pump of the instant invention comprises a pump tube, a piston rod with a piston extending into the tube and two valves. The pump tube is adapted to be disposed with its closed lower end in a container of lubricant. Adjacent the closed lower end, is a lateral inlet port for entry of lubricant into the tube. A head is provided at the upper end of the tube. The head has an outlet port and an aperture for the reciprocation therethrough of the piston rod in sliding sealing engagement. One of the valves is a check valve in a passage in the piston and the other valve comprises a cylinder in sliding fit in the tube that closes and opens the inlet port. The valves cooperate upon the piston downstroke to close the inlet port while lubricant passes through the check valve from below the piston to above the piston and, upon the upstroke, to force the lubricant above the piston through the outlet port while drawing lubricant into the tube through the then open inlet. The inlet port is opened, however, only after a portion of the piston upstroke has been completed and after a substantial vacuum has been developed at the inlet. Upon the opening of the inlet port, there is then a sudden exposure of the lubricant surrounding the inlet to the developed vacuum, which draws the lubricant into the pump tube to prime it.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
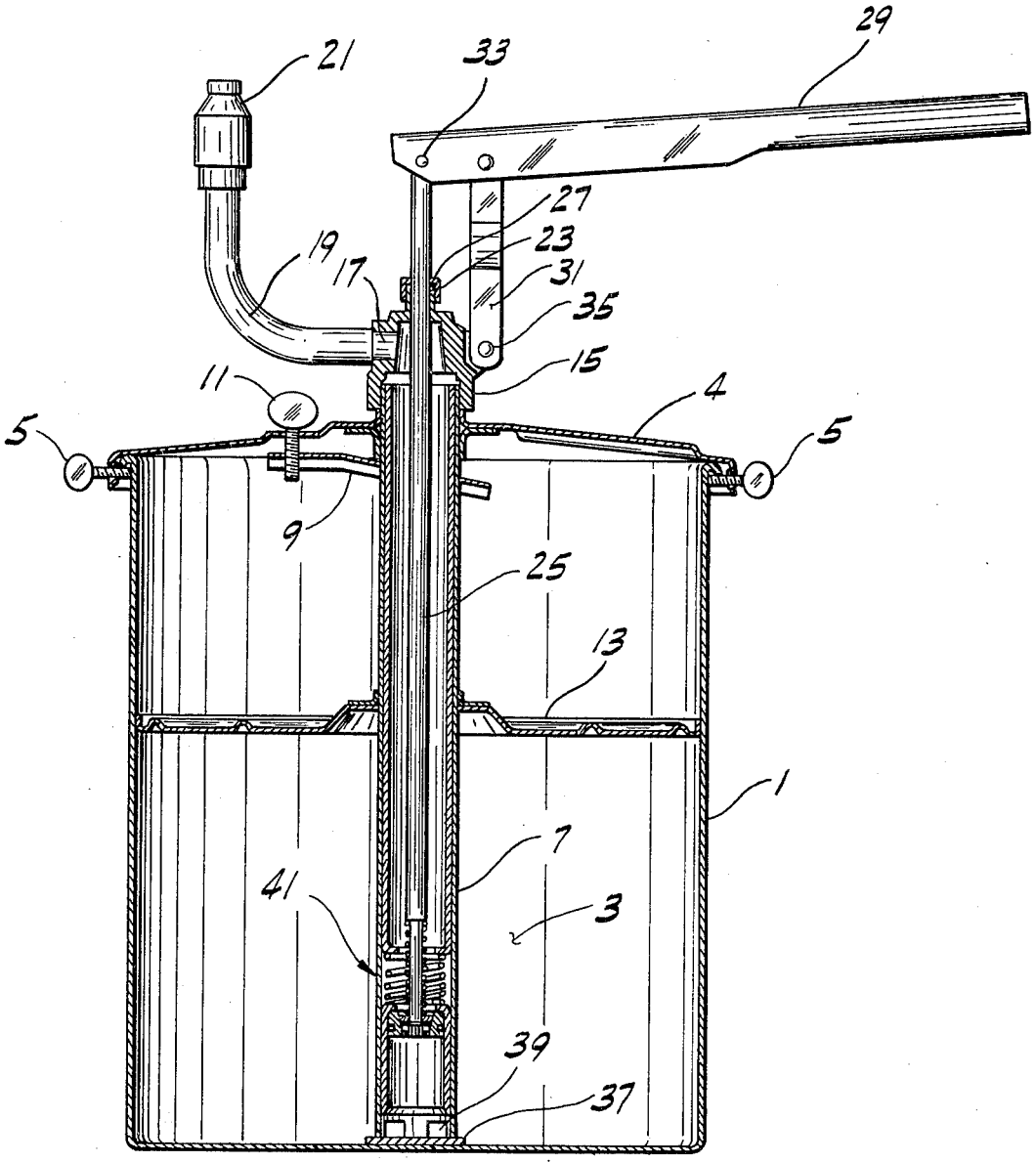
FIG. 1 is an overall view of a first embodiment of the pump of this invention with parts shown in cross-section.

Referring to FIG. 1, there is shown a first embodiment of a pump of the present invention for pumping lubricant or other material and, in particular, high viscosity lubricant for packing wheel bearings, the lower portion of which is in a container 1 of lubricant 3 to be pumped. The pump is supported from the top of the container 1 by means of a container cover assembly 4 secured to the top edges of the container by thumbscrews 5. The pump tube 7 extends down into the container. Its vertical position is adjustable by means of clamp 9 and thumbscrew 11. Also in the container 1 is a follower assembly 13 that separates the lubricant 3 from the air space in the top of the container. The follower assembly 13 surrounds and is in sliding engagement with the pump tube 7. It moves down as the lubricant 3 is pumped out of the container 1 and the lubricant level drops.

Figure 3:
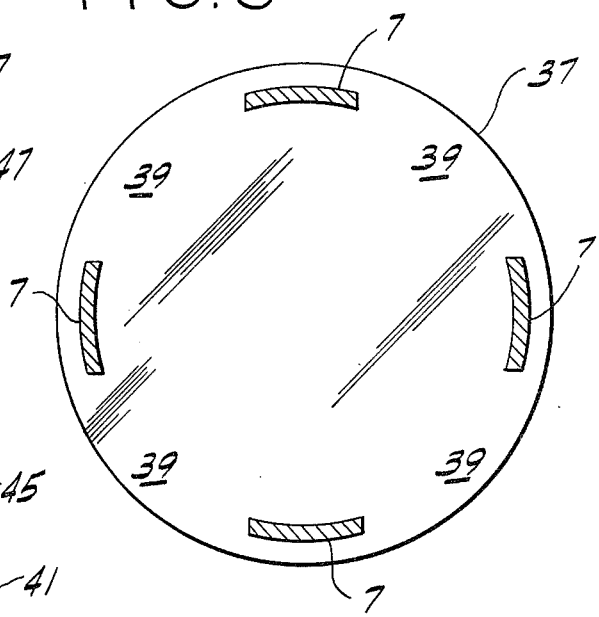
FIG. 3 is a section on line 3—3 of FIG. 2.
Figure 5:
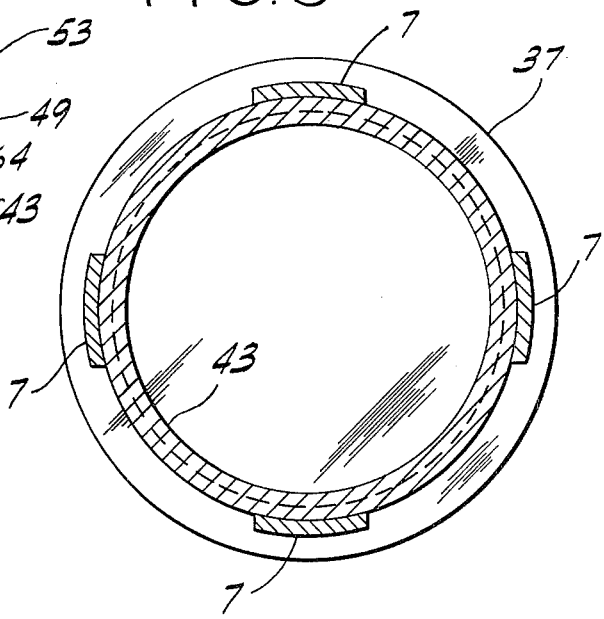
FIG. 5 is a section on line 5—5 of FIG. 4.

The pump tube 7 has a head 15 attached at its upper end. The head 15 has an outlet port 17 for the flow of lubricant out of the pump tube 7. Connected to the outlet port 17 is an outlet pipe 19. The latter may be equipped with a nozzle fitting 21 which in turn may be connected to other lubricating equipment such as a grease gun (not shown). Alternatively, the outlet pipe 19 may be connected directly to the apparatus to be lubricated. The head also has an aperture 23 in which the piston rod 25 is slidable. Sealing means for the piston rod is indicated at 27. The vertical movement of the piston rod 25 through the head is effected by moving a handle 29. Handle 29 is pinned to link 31 and is attached to the piston rod 25 by pin 33. The link 31 is attached to the head 15 by pin 35. The vertical movement of the piston rod 25 may be accomplished, alternatively, by other known manual or power means, such as, for example, hydraulic and pneumatic cylinders. The lower end of the pump tube 7 is closed by plate 37. Adjacent the plate 37 is at least one lateral inlet port 39 for the flow of the lubricant 3 into the tube 7. Preferably, the inlet consists of four ports equally spaced around the pump tube 7 as shown in FIGS. 3 and 5.

Figure 2:
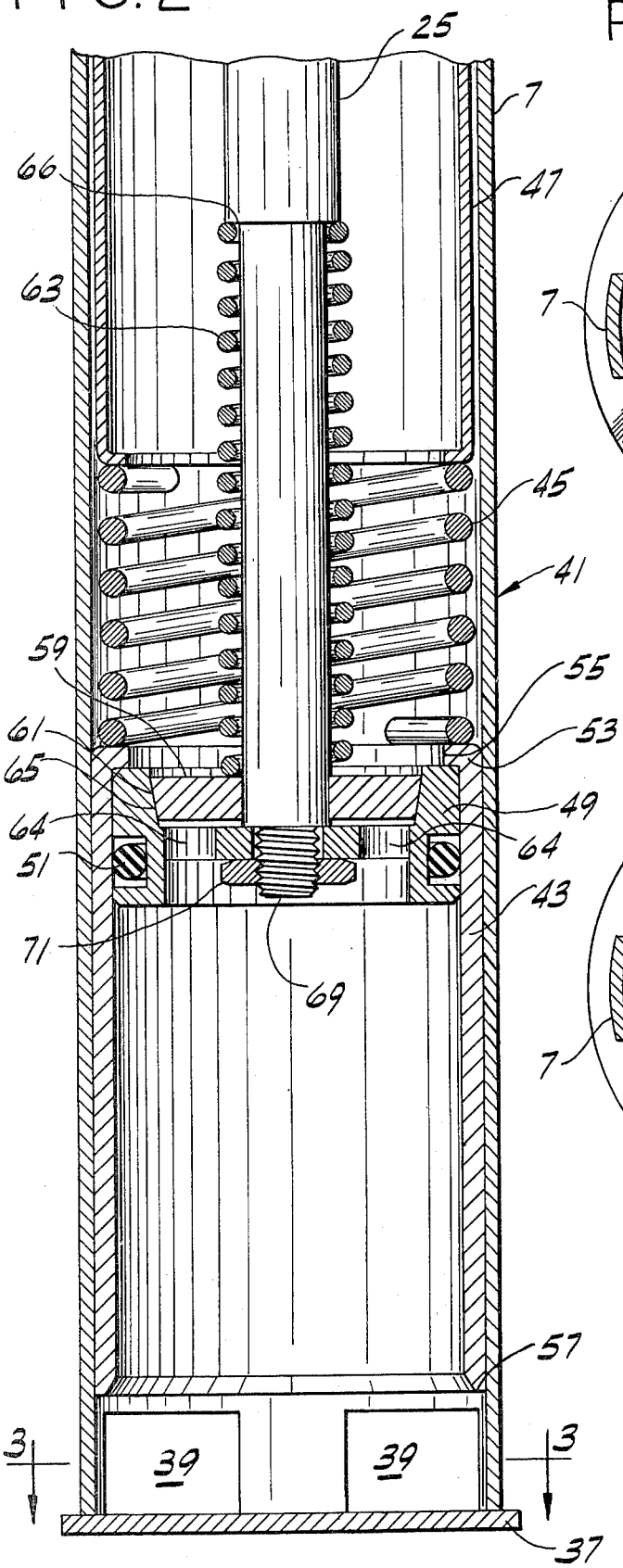
FIG. 2 is an enlarged section of the piston and the valves of the first embodiment of the pump, showing the piston at the upper limit of its stroke.
Figure 4:
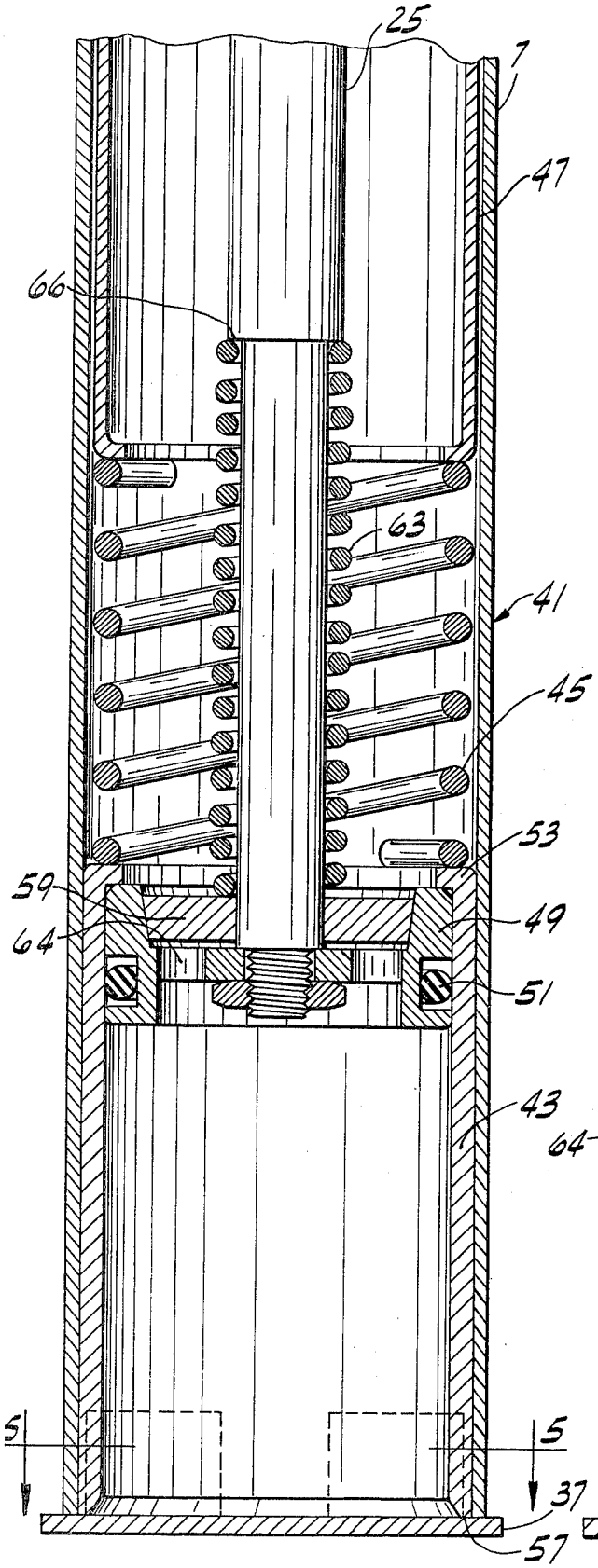
FIG. 4 is an enlarged section similar to FIG. 2 showing parts in a moved position.

Shown generally in FIG. 1 and in detail in FIG. 2 is the piston and valve assembly 41. This assembly has two separate one-way flow valves that cooperate to provide the desired pumping action. The first of these valves comprises a hollow cylindrical valve member 43 in sliding sealing engagement within tube 7. The valve member is biased to its down position shown in FIGS. 4 and 6 by a spring 45 compressed between the valve member 43 and a tube 47 fixedly mounted in tube 7. The valve member 43 is moved up against the spring bias by means of its engagement with piston 49 when the piston moves upwardly. The piston 49 is in sliding sealing engagement with the interior wall surface of the valve member 43 by means of an O-ring 51. The side of piston 49 toward the outlet port and the lower end of spring 45 are engageable with a radially inwardly extending flange 53 at the upper end of the valve member 43. The flange 53 bounds an opening 55 through which the piston rod 25 extends. In its down position (FIGS. 4–6), the valve member 43 blocks the flow of lubricant through the inlet ports 39. In its raised position, the inlet ports 39 are open (see FIGS. 2 and 3). The lower end of the valve member 43 is tapered as indicated at 57. The movement of the sliding valve member 43 across the inlet ports 39 in closing the ports together with the taper 57 minimizes the likelihood that dirt or foreign matter will obstruct the complete closure of the valve member, thereby preventing lubricant leakage past the valve member. Leakage at the inlet, during the piston downstroke, reduces the amount of lubricant transferred from below the piston to above the piston and the amount available for discharge upon the upstroke. If the amount of lubricant leakage is large, a void may occur below the piston 49 during the upstroke, thereby causing a loss of prime.

Figure 6:
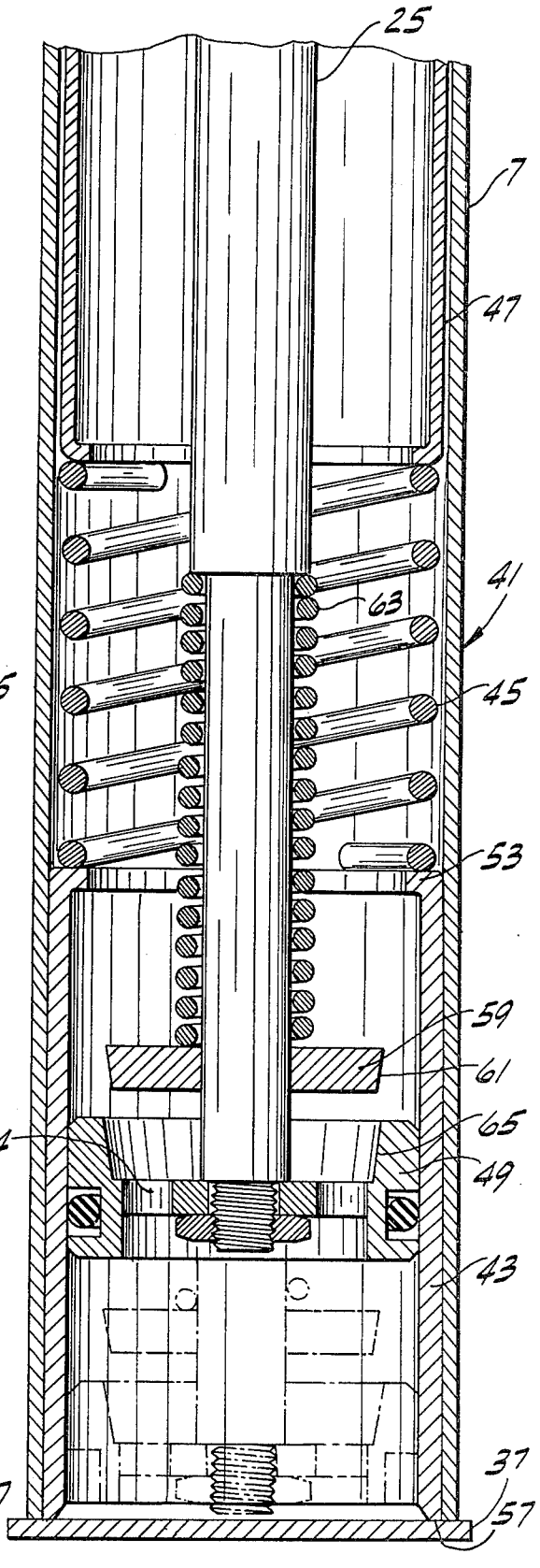
FIG. 6 is an enlarged section of the piston similar to FIG. 4 showing parts in a further moved position, and showing in phantom the piston at the lower limit of its stroke.

The second valve is a check valve comprising a movable valve disc 59 with a conical surface 61, the disc being biased by a spring 63 into contact with a complementary conical seating surface 65 in the piston 49. The spring 63 is disposed around the piston rod 25 and is compressed between the valve disc 59 and piston rod shoulder 66. In the biased closed position of the disc 59, as shown in FIG. 2, the complementary conical surfaces 61 and 65 are in engagement and the valve blocks the flow of lubricant from the pump tube above the piston to the valve member 43 below the piston. Such blockage of flow is necessary during an upstroke of the piston 49, when pressure is developed in the pump tube above the piston, in order to force the lubricant from the pump tube 7 through the outlet port 17. The disc 59 is moved out of its biased closed position and the complementary conical surfaces 61 and 65 are moved out of engagement, when the piston 49 is moved through a downstroke, as shown in FIG. 6. During a downstroke of the piston 49, pressure is applied to the lubricant within the valve member 43 which acts on the valve disc 59 to overcome the bias of spring 63 and move disc 59 away from the seating surface 65, and lubricant is forced through passages 64 in the piston to the pump tube 7 above the piston and out through the outlet port 17.

The piston 49 is attached to the piston rod 25 by means of threaded extension 69 and nut 71. During a downstroke of the piston 49 and piston rod 25 from their uppermost position, the piston 49 and valve member 43 move down together within the pump tube 7 until the lower end of the valve member 43 engages the end closure plate 37, whereupon inlet ports 39 are closed by valve member 43 (see FIG. 4). Thereafter, the piston 49 moves down in sealing engagement within the then stationary valve member 43 until the piston 49 engages the end closure plate 37 (see FIG. 6). During an upstroke of the piston 49 from its lowermost position, the piston 49 slides up within the valve member 43, while the latter remains down and the inlet ports 39 remain closed, until the piston 49 engages the flange 53 of valve member 43. Thereafter, further upward movement of the piston 49 results in the piston 49 and valve member 43 moving up together against the bias of spring 45 in the opening inlet ports 39. Thus, the piston engages the valve member to lift it from its closed to its open position after an interval of lost motion as the piston moves up from its lowered position.

The interval of lost motion of the piston 49 within the valve member 43 is important in that it enables the piston to develop a substantial vacuum before the inlet ports 39 are opened and the sudden exposure of the lubricant surrounding the inlet to the vacuum upon opening the inlet ports 39 so that the lubricant rushes into the pump tube 7. The sudden exposure of high viscosity lubricant to the developed vacuum has been found to be more effective in causing lubricant flow than the exposure of such lubricant to a gradually increasing vacuum.

Figure 7:
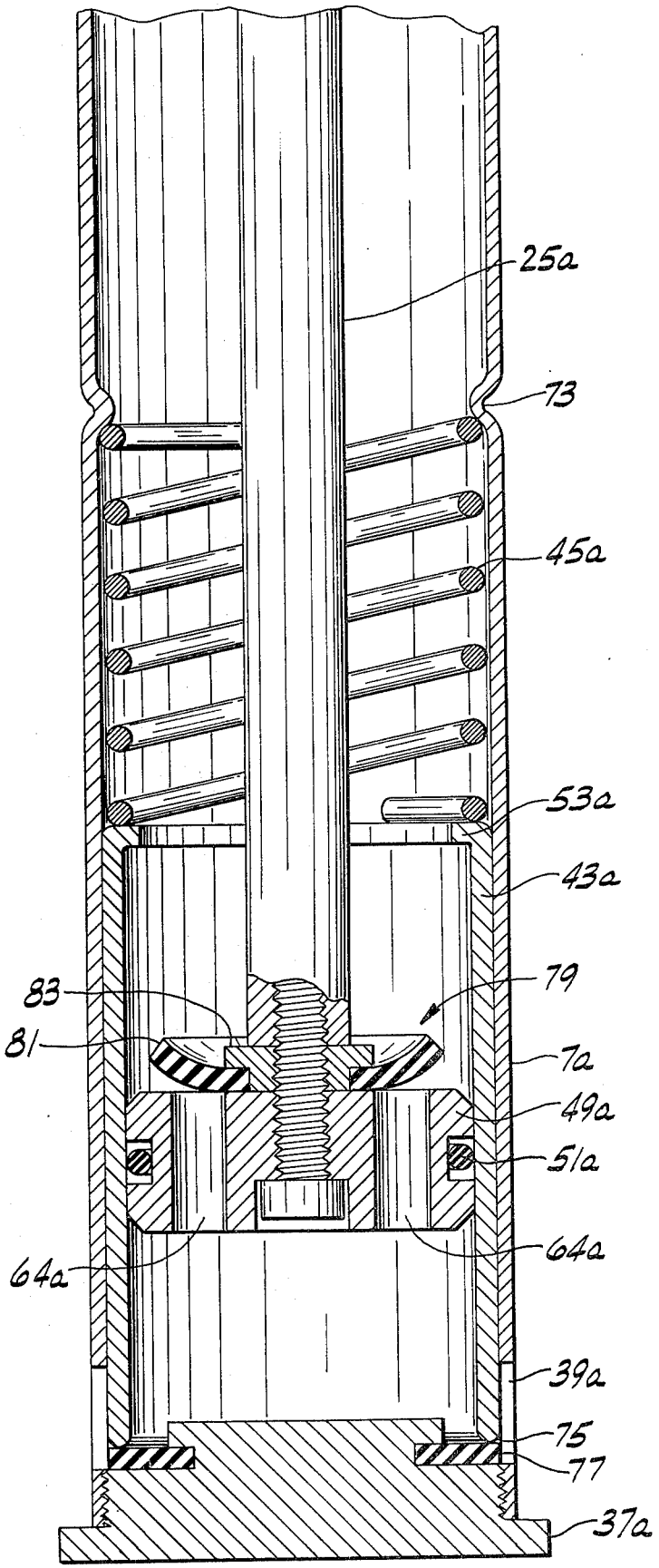
FIG. 7 is an enlarged section of the piston and the valves of a second embodiment of the pump.

Referring to FIG. 7, there is shown an enlarged section of the piston and of the valves of a second embodiment of the pump of this invention. This embodiment of the pump is functionally and structurally similar to that of the first embodiment. Like the first embodiment, the pump of this embodiment is suspended from the container cover assembly by its pump tube into a container of the lubricant to be pumped (see FIG. 1). Further, this embodiment of the pump comprises a pump tube **7*a* closed at its lower end, a valve member 43*a* slideable up and down in the tube between a closed and an open position, spring means 45*a* in the tube 7*a* biasing the valve member 43*a* down to its closed position and a piston 49*a* in sealing, sliding engagement with the inner surface of the valve member 43*a***.

This embodiment of the pump differs from that of the first embodiment principally in the configuration and attachment means of the pump tube end closure plate, the means seating the lower end of the slideable valve member and the type of check valve used in the piston (see FIGS. 6 and 7).

Closure plate **37*a* is removably secured by means of screw threads to the lower end of pump tube 7*a*. Adjacent the plate 37*a* are lateral inlet ports 39*a* for the flow of lubricant into the tube 7*a***.

Spring **45*a*, compressed between a radially inwardly extending flange 53*a* of the valve member 43*a* and indentations 73 in the side of the pump tube 7*a*, biases the valve member 43*a* into its closed position. The valve member has a rounded lower end 75 that sealingly engages a gasket 77 secured to the end closure plate 37*a*, when the valve member 43*a* is in its closed position. Like the tapered end 57 of the valve member 43 of the first embodiment, the rounded end 75 and gasket 77** prevent lubricant leakage past the valve member during the piston downstroke which would reduce the amount of lubricant available for discharge upon the piston upstroke and which could cause loss of prime.

The check valve 79 in the piston **49*a* comprises a deformable disc 81 secured to the piston rod 25*a* at the top of piston 49*a* by means of retainer 83. During the piston upstroke, the deformable check valve 81 is pressed down into a flat configuration against the upper surface of the piston 49*a* to block lubricant flow. During the piston downstroke, the disc 81 deforms upwardly due to the pressure developed below the piston acting on the disc 81 through passages 64***a* to permit lubricant flow through the piston 49*a*.

In the operation of the first embodiment of the pump of this invention, the piston rod 25 and piston 49 are moved down until the piston engages end closure plate 37. During this downstroke, the slide valve member 43 closes inlet ports 39 and the lubricant in the valve member 43 is subjected to a pressure causing the valve disc 59 to move up and complementary surfaces 61 and 65 to separate so that the lubricant flows through the piston 49 to the pump tube 7 above the piston 49. Upon the upstroke, the piston 49 moves up within the valve member 43 during the above-described lost motion interval, the valve member 43 remaining in its down position closing the inlet ports 39 until the piston 49 engages flange 53 of valve member 43. During the lost motion interval, a substantial vacuum is developed within the valve member 43 so that when the piston 49 does engage the flange 53 of the valve member 43 and the inlet ports 39 are opened, the lubricant 3 surrounding the inlet is suddenly exposed to the vacuum, thereby causing the lubricant to rush into the pump tube 7 and valve member 43. Subsequent downstrokes and upstrokes transfer the lubricant from the valve member to the pump tube 7 above the piston 49 and fill the valve member 43 with lubricant. With the pump tube above the piston completely filled, upstrokes of the piston 49 result in the lubricant being forced out of the pump tube 7 through the outlet port 17. The operation of the second embodiment of the pump is similar to that of the first embodiment.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A pump for pumping lubricant or other material comprising:

a pump tube adapted to be placed in a container holding a supply of material to be pumped with the tube extending down toward the bottom of the container, said tube having a head at its upper end with a material outlet in said head, said tube being closed at its lower end and having at least one lateral inlet adjacent its closed lower end for entry into the tube of lubricant or other material to be pumped, a valve member slidable up and down in the tube between a lowered closed position blocking the inlet and a raised open position unblocking the inlet, spring means in the tube biasing the valve member down to its closed position, a piston rod having a sealing fit in the head and extending down into the tube, a piston on the lower end of the rod, the rod being movable up and down in the tube to move the piston through an upstroke from a lowered position adjacent the lower end of the tube to a raised position, and down from the raised position through a downstroke, the piston being engageable with the valve member on each upstroke of the piston after an interval of lost motion as the piston moves up from its lowered position to lift the valve member from its closed to its open position, the valve member remaining down in its lowered position until the engagement of the piston with the valve member, the piston thereby developing a vacuum in the pump tube during said lost motion interval, the piston allowing the valve member to move down to its closed position under the bias of said spring means when the piston moves down through a downstroke from its raised position, the piston continuing to move down after the valve member reaches its closed position, said piston having a passage therethrough for flow of lubricant from below the piston to above the piston as the piston moves down through a downstroke and having a check valve for said passage adapted to open on a downstroke and close on an upstroke of the piston, whereby on a downstroke the valve member moves down to close the inlet and the piston forces material through the passage in the piston and whereby on an upstroke the piston forces material out the outlet, develops said vacuum, and then moves the valve member up to open the inlet for entry of material to prime the tube below the piston.

2. A pump as set forth in claim 1 wherein the valve member is a hollow cylindrical member and the piston has a sliding sealing fit therein.

3. A pump as set forth in claim 1 wherein the valve member at its end adjacent the outlet has a radially inwardly extending flange, said flange defining an opening through which the piston rod extends.

4. A pump as set forth in claim 1 wherein said valve member is in sliding sealing engagement with the tube.

5. A pump as set forth in claim 1 wherein the valve member, in moving from its closed position to its open position, releases the vacuum through the inlet, the vacuum drawing material into the pump tube through the inlet.

6. A pump as set forth in claim 1 wherein the lower portion of the valve member is tapered.

7. A pump for pumping lubricant or other material comprising:

a pump tube adapted to be placed in a container holding a supply of material to be pumped with the tube extending down toward the bottom of the container, said tube having a head at its upper end with a material outlet in said head, said tube being closed at its lower end and having at least one lateral inlet adjacent its closed lower end for entry into the tube of lubricant or other material to be pumped, a valve member slidable up and down in the tube between a lowered closed position blocking the inlet and a raised open position unblocking the inlet, spring means in the tube biasing the valve member down to its closed position, a piston rod having a sealing fit in the head and extending down into the tube, a piston on the lower end of the rod, the rod being movable up and down in the tube to move the piston through an upstroke from a lowered position adjacent the lower end of the tube to a raised position, and down from the raised position through a downstroke, the piston being engageable with the valve member on each upstroke of the piston to lift the valve member from its closed to its open position, and allowing the valve member to move down to its closed position under the bias of said spring means when the piston moves down through a downstroke from its raised position, said piston having a passage therethrough for flow of lubricant from below the piston to above the piston as the piston moves down through a downstroke and having a check valve for said passage adapted to open on a downstroke and close on an upstroke of the piston, whereby on a downstroke the valve member moves down to close the inlet and the piston forces material through the passage in the piston and whereby on an upstroke the piston forces material out the outlet and moves the valve member up to open the inlet for entry of material to prime the tube below the piston, an end of the valve member adjacent the outlet having a radially inwardly extending flange, said flange defining an opening through which the piston rod extends and being engageable with the side of the piston toward the outlet during the upstroke of the piston.

8. A pump for pumping lubricant or other material comprising:

a pump tube adapted to be placed in a container holding a supply of material to be pumped with the tube extending down toward the bottom of the container, said tube having a head at its upper end with a material outlet in said head, said tube being closed at its lower end and having at least one lateral inlet adjacent its closed lower end for entry into the tube of lubricant or other material to be pumped, a valve member slideable up and down in the tube between a lowered closed position blocking the inlet and a raised open position unblocking the inlet, spring means in the tube biasing the valve member down to its closed position, a piston rod having a sealing fit in the head and extending down into the tube, a piston on the lower end of the rod, the rod being movable up and down in the tube to move the piston through an upstroke from a lowered position adjacent the lower end of the tube to a raised position, and down from the raised position through a downstroke, the piston being engageable with the valve member on each upstroke of the piston to lift the valve member from its closed to its open position, and allowing the valve member to move down to its closed position under the bias of said spring means when the piston moves down through a downstroke from its raised position, said piston having a passage therethrough for flow of lubricant from below the piston to above the piston as the piston moves down through a downstroke and having a check valve for said passage adapted to open on a downstroke and close on the upstroke of the piston, whereby on a downstroke the valve member moves down to close the inlet and the piston forces material through the passage in the piston and whereby on an upstroke the piston forces material out the outlet and moves the valve member up to open the inlet for entry of material to prime the tube below the piston, an end of the valve member adjacent the outlet having a radially inwardly extending flange, said flange defining an opening through which the piston rod extends, said spring means acting against said flange to bias the valve member down to its closed position.

9. A pump for pumping lubricant or other material comprising:

a pump tube adapted to be placed in a container holding a supply of material to be pumped with the tube extending down toward the bottom of the container, said tube having a head at its upper end with a material outlet in said head, said tube being closed at its lower end and having at least one lateral inlet adjacent its closed lower end for entry into the tube of lubricant or other material to be pumped, a valve member slideable up and down in the tube between a lowered closed position blocking the inlet and a raised open position unblocking the inlet, spring means in the tube biasing the valve member down to its closed position, a piston rod having a sealing fit in the head and extending down into the tube, a piston on the lower end of the rod, the rod being movable up and down in the tube to move the piston through an upstroke from a lowered position adjacent the lower end of the tube to a raised position, and down from the raised position through a downstroke, the piston being engageable with the valve member on each upstroke of the piston to lift the valve member from its closed to its open position, and allowing the valve member to move down to its closed position under the bias of said spring means when the piston moves down through a downstroke from its raised position, said piston having a passage therethrough for flow of lubricant from below the piston to above the piston as the piston moves down through a downstroke and having a check valve for said passage adapted to open on a downstroke and close on an upstroke of the piston, whereby on a downstroke the valve member moves down to close the inlet and the piston forces material through the passage in the piston and whereby on an upstroke the piston forces material out the outlet and moves the valve member up to open the inlet for entry of material to prime the tube below the piston, said valve member being caused to move to its closed position by engagement therewith of the spring means during the piston downstroke and to its open position by engagement therewith of the piston during the piston upstroke.

10. A pump for pumping high viscosity material such as wheel bearing grease, comprising a pump tube with one of its two ends adapted for being disposed within a container holding a supply of material to be pumped, said tube being closed at its one said end, said tube having at least one lateral inlet port adjacent said end, said tube having a head at the other end, said head having passage means for the movement therethrough of a piston rod through an upstroke and a downstroke and having a discharge port, said piston rod having a piston on an end thereof, said piston being disposed within the tube and having an opening with a check valve adapted to open for the flow of material from the side of the piston toward the inlet port to the side of the piston toward the outlet port, and a valve member within the tube adjacent the inlet port and movable between a closed position blocking the inlet port and an open position unblocking the inlet port, the piston rod being movable up and down in the tube to move the piston through an upstroke from a lowered position adjacent the lower end of the tube to a raised position, and down from the raised position through a downstroke, the piston being engageable with the valve member on each upstroke of the piston after an interval of lost motion as the piston moves up from its lowered position to lift the valve member from its closed to its open position, the valve member remaining down in its lowered position until the engagement of the piston with the valve member, the piston thereby developing a vacuum in the pump tube during said lost motion interval, the piston allowing the valve member to move down to its closed position when the piston moves down through its downstroke from its raised position, the piston continuing to move down after the valve member reaches its closed position, the check valve and the valve member operating so that during a downstroke of the piston the check valve allows material flow through the piston while the valve member prevents material flow out through the inlet port and so that during an upstroke of the piston the check valve prevents material flow through the piston while the valve member allows material flow in through the inlet port, whereby upon the piston upstroke material is forced out the outlet port and is drawn into the pump tube at the inlet port by the vacuum to prime the pump and upon the piston downstroke material flows through the piston.

11. A pump as set forth in claim 10 wherein the valve member comprises a hollow cylindrical member having a sliding sealing fit within the pump tube, the piston having a sliding sealing fit within the cylindrical member.

12. A pump as set forth in claim 11 further comprising a gasket secured to the closed end of the pump tube and wherein the end of the cylindrical member adjacent the inlet port is sealingly engageable with said gasket.

13. A pump as set forth in claim 10 wherein the valve member has at an end remote from the inlet port a radially inwardly extending flange defining an opening through which the piston rod extends.

14. A pump as set forth in claim 13 wherein the valve member is biased to the closed position by means of a spring engaging the flange.

15. A pump for pumping high viscosity material such as wheel bearing grease, comprising a pump tube with one of its two ends adapted for being disposed within a container holding a supply of material to be pumped, said tube being closed at its one said end, said tube having at least one lateral inlet port adjacent said end, said tube having a head at the other end, said head having passage means for the movement therethrough of a piston rod through an upstroke and a downstroke and having a discharge port, said piston rod having a piston on an end thereof, said piston being disposed within the tube and having an opening with a check valve adapted to open for the flow of material from the side of the piston toward the inlet port to the side of the piston toward the outlet port, and a valve member within the tube adjacent the inlet port and movable between a closed position blocking the inlet port and an open position unblocking the inlet port, the valve member being caused to move from its closed position only after a portion of the piston upstroke has been completed and a vacuum has been developed at the inlet port, the check valve and the valve member operating so that during a downstroke of the piston the check valve allows material flow through the piston while the valve member prevents material flow out through the inlet port and so that during an upstroke of the piston the check valve prevents material flow through the piston while the valve member allows material flow in through the inlet port, whereby upon the piston upstroke material is forced out the outlet port and is drawn into the pump tube at the inlet port by the vacuum to prime the pump and upon the piston downstroke material flows through the piston, the piston being disposed near the inlet port at the end of its downstroke, the vacuum being developed during a first portion of the upstroke of the piston from its position adjacent the inlet port, the piston, in moving beyond the first portion of its upstroke, engages and moves the valve means to its open position thereby exposing the material surrounding the inlet port to the developed vacuum, the valve member having at an end remote from the inlet port a radially inwardly extending flange defining an opening through which the piston rod extends, said side of the piston toward the outlet port engaging the flange during the upstroke of the piston.

* * * * *